United States Patent [19]

Schaefer

[11] 4,048,989

[45] Sept. 20, 1977

[54] TISSUE PULSATOR OPERATING WITH A TAPPING ACTION, AND METHOD

[76] Inventor: E. Lowell Schaefer, 6347 Deerfield Ave., San Gabriel, Calif. 91775

[21] Appl. No.: 680,760

[22] Filed: Apr. 27, 1976

[51] Int. Cl.[2] ..... A61H 23/00

[52] U.S. Cl. ..... 128/55

[58] Field of Search ..... 128/55, 49, 52, 46, 128/51, 44, 24.2, 46

[56] References Cited

U.S. PATENT DOCUMENTS

| | | | |
|---|---|---|---|
| 794,003 | 7/1905 | Gates | 128/51 |
| 795,212 | 7/1905 | Fitz | 128/46 |
| 899,234 | 9/1908 | Wantz | 128/49 |
| 934,662 | 9/1909 | Faison | 128/52 |
| 1,006,684 | 10/1911 | Sands | 128/46 |
| 1,388,020 | 4/1920 | Kojima | 128/49 |
| 3,837,335 | 9/1974 | Teranishi | 128/55 |

*Primary Examiner*—Lawrence W. Trapp
*Attorney, Agent, or Firm*—Harris, Kern, Wallen & Tinsley

[57] ABSTRACT

A tissue pulsator capable of operating on an area to be treated with a tapping action. The device includes a pulsator head having a laterally facing pad provided with a convex surface engageable with the area to be treated, and a rotary eccentric drive connected to the head for laterally moving the convex surface thereof inwardly and outwardly substantially parallel to itself so as to operate on tissue underlying the area to be treated with a tapping action.

4 Claims, 8 Drawing Figures

TISSUE PULSATOR OPERATING WITH A TAPPING ACTION, AND METHOD

BACKGROUND OF INVENTION

The present invention relates to the general field of massagers and massaging methods and, more particularly, to a tissue pulsator and method which operate on tissue underlying an area to be treated with a tapping action generally perpendicular to such area, as opposed to a surface motion substantially in the plane of the area to be treated.

Relevant prior art known to me comprises the following U.S. patents: U.S. Pat. No. 855,594, Stecker; U.S. Pat. No. 942,596, Stecker; U.S. Pat. No. 943,620, Stecker; U.S. Pat. No. 973,770, Gates; U.S. Pat. No. 1,175,262, Heintze; U.S. Pat. No. 1,787,211, Priest; U.S. Pat. No. 1,198,799, Westrup; U.S. Pat. No. 3,699,952, Waters et al.

With the exception of Waters et al., the foregoing patents show circularly orbiting massaging heads which are applied endwise to the area to be treated so that they operate on such area with a motion substantially in the plane thereof, and not with a tapping action generally perpendicular to such plane. Waters et al discloses a laterally applied massaging head which is moved in an elliptical orbit substantially in the plane of the area being treated, and not with a tapping action generally perpendicular to such plane.

OBJECTS AND SUMMARY OF INVENTION

With the foregoing background in mind, the present invention may be summarized as including, and the primary object of the invention is to provide a tissue pulsator, operating with a tapping action, which includes: a pulsator head having on one side thereof a surface engageable with the area to be treated; and rotary eccentric means connected to the head for laterally moving said surface thereof inwardly and outwardly substantially parallel to itself so as to operate on tissue underlying the area to be treated with a tapping action.

An important object of the invention is to provide a tapping action having a frequency ranging between just above zero and about 5000 cycles per minute, depending upon the consistency of the tissue underlying the area being treated, with the optimum frequency being about 4000 cycles per minute.

Another important object is to provide a head which comprises a laterally facing, enlarged pad having a surface on one side thereof which is at least slightly convex in all directions.

The invention may be summarized further as including, and another important object is to provide a tissue pulsator which includes: a housing providing a socket; a shaft having inner and outer ends and having intermediate its inner and outer ends a ball disposed in the socket; the pulsator head being connected to the outer end of the shaft; a crank connected to the inner end of the shaft; a rotary motor in the housing and substantially coaxial with the shaft and connected to the crank for rotating the crank substantially about the axis of the shaft so as to cause the outer end of the shaft to orbit, thereby laterally moving the operative surface of the pulsator head inwardly and outwardly substantially parallel to itself so as to operate on the area to be treated with a tapping action; and means interconnecting the shaft and the housing for preventing rotation of the shaft about its axis. A related object is to provide a pulsator wherein the crank comprises a bearing encircling the inner end of the shaft and eccentrically connected to the shaft of the rotary motor.

Another object is to provide means for varying the speed of the rotary motor throughout the range hereinbefore discussed.

USES FOR AND RESULTS OBTAINED WITH INVENTION

The pulsator of the present invention should be utilized only on areas overlying tissue which is easily palpable, and not to areas overlying bony prominences, or the like. When applied to readily palpable tissue, the tapping action generated by the present invention produces a pulsating motion in the tissue causing contraction and relaxation of the tissue at frequencies of the order hereinbefore outlined. Such contraction and relaxation of the tissue generate beneficial heat therein which is transmitted to underlying tissue and joints as well. The pulsating action has the further beneficial results of improving circulation and relaxing tense and contracted tissues.

The mechanical effect of the tissue pulsator of the invention on palpable tissue is much like the effect of a stone dropped into still water. In other words, the pulsations undulate or ripple outwardly somewhat as illustrated in FIG. 1 of the drawings annexed to this specification and discussed hereinafter.

Other beneficial results achieved by the pulsating or tapping action of the present invention are to: help restore function in muscle, fascia, ligamentous and bony tissues; reduce pain, spasm and stiffness by increasing circulation to the area treated and by fatiguing of the afferent and efferent nerve fibers which may produce a type of anesthetic effect; reduce need for such drugs as analgesics, sedatives, antispasmodics and cortiosteroids; and assist in restoring function of tissues injured by fractures, surgery or trauma, usually after healing is established.

Results of the foregoing nature can be achieved only with the pulsating, tapping action of the present invention, and cannot be achieved with a vibratory action in the plane of the area being treated.

The pulsating, tapping action of the present invention is beneficial for such conditions as: mechanical injury; sprains and strains of muscles, tendons, ligaments and periarticular tissue; arthritis; fibrositis and myosclerosis; polymyalgia rheumatica; polymyostis; low back strain or sprain, acute or chronic; tendonitis and bursitis, acute or chronic; rotator cuff lesions; adhesive capsulitis; fibromyopathies of the shoulders; sciatica; post fracture edema and stiffness; psychogenic rheumatism, such as chronically increased muscle tension; and muscle attachments as epicondylitis and iliac crests.

The foregoing objects, advantages, features and results of the present invention, together with various other objects, advantages, features and results which will be evident to those skilled in the art in the light of this disclosure, may be achieved with the exemplary embodiment of the invention illustrated in the accompanying drawings and described in detail hereinafter.

DETAILED DESCRIPTION OF EXEMPLARY EMBODIMENT OF INVENTION

Figure 1:
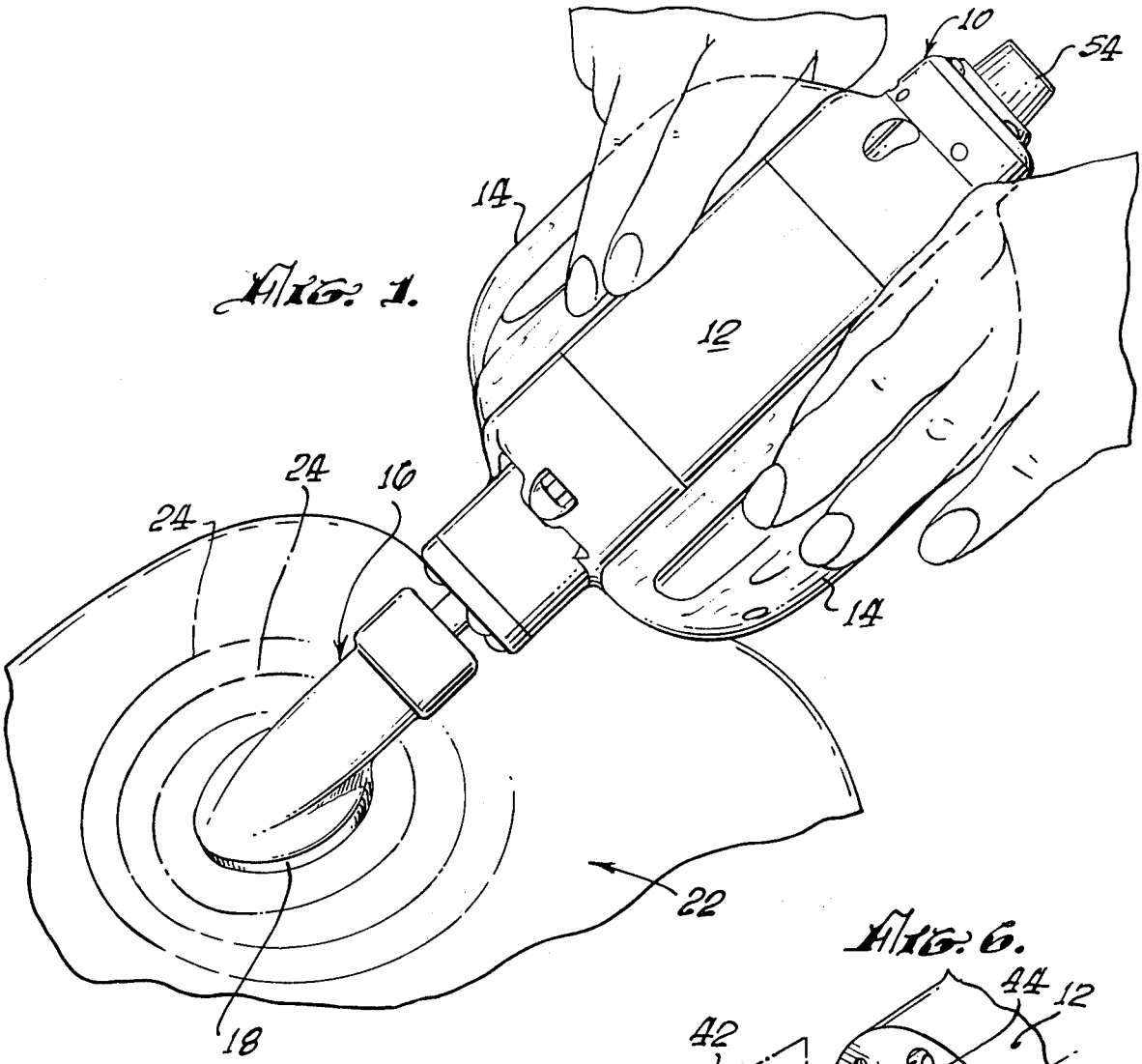
FIG. 1 is a perspective view illustrating the use of the tissue pulsator of the invention on palpable tissue.
Figure 7:
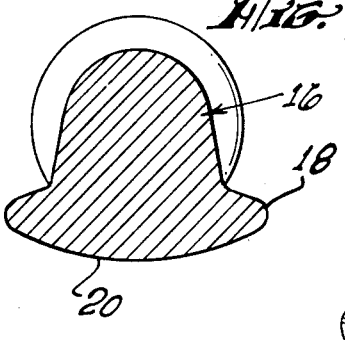
FIG. 7 is a transverse sectional view through the pulsator head taken as indicated by the arrowed line 7—7 of FIG. 2.

Referring initially to FIG. 1 of the drawings, the tissue pulsator of the invention is designated generally by the numeral 10 and includes an elongated housing 12 provided with suitable hand grips 14 and having a pulsator head 16 projecting axially from one end thereof. The head 16 comprises an enlarged, laterally facing pad 18 having on one side thereof, FIGS. 2 and 7, a laterally facing surface 20 which is convex in all directions. When the surface 20 is applied to an area 22, FIG. 1, to be treated, this surface is caused to move inwardly and outwardly substantially parallel to itself, as hereinafter described, so as to operate on the area 22 with a pulsating, tapping action. As previously discussed, this produces waves or ripples in the palpable tissue, as designated by the numeral 24, with the attendant beneficial results earlier set forth.

The pulsator 10 also includes a rotary eccentric drive means 30 connected to the head 16 for laterally moving the convex surface 20 thereof inwardly and outwardly substantially parallel to itself so as to operate on the area 22 to be treated with the desired pulsating, tapping action.

Figure 6:
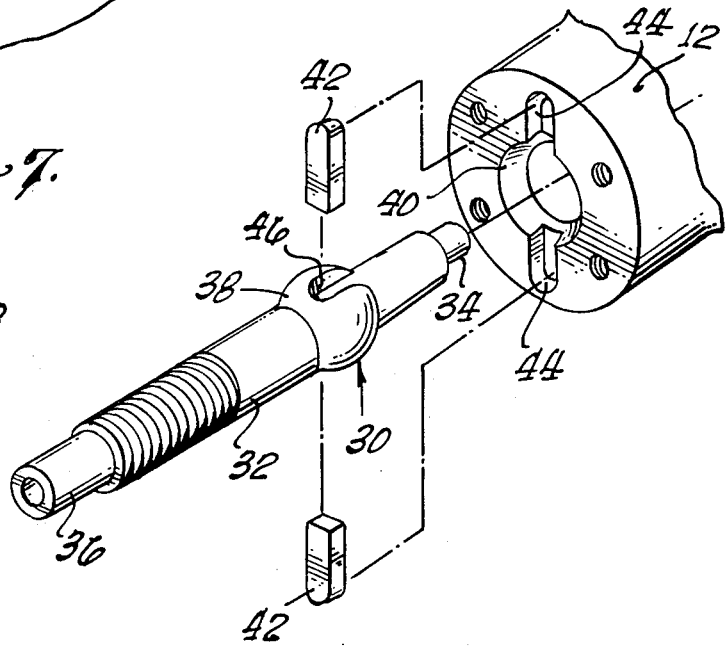
FIG. 6 is an exploded perspective view showing a ball and socket joint incorporated in the pulsator of the invention between a pulsator head shaft and a housing thereof.

Considering the rotary eccentric drive means 30 in more detail, it includes a member 32 which will be referred to herein as a shaft for convenience and which has inner and outer ends 34 and 36 and a ball 38 intermediate its ends. The shaft 32 is substantially coaxial with the housing 12 and the ball 38 thereon is disposed in a socket 40 within the housing 12. Rotation of the shaft 32 is prevented by keys 42, FIGS. 2 and 6, disposed in suitable recesses 44 in the housing and in keyways 46 in the ball 38. The head 16 is suitably mounted on the outer end 36 of the shaft 32, as by threading.

Within the housing 12 is a variable speed electric motor 50 having a rotary output shaft 52 substantially coaxial with the shaft 32. At the end of the housing 12 opposite the pulsator head 16 is a speed control 54 for varying the speed of the electric motor 50 throughout the range hereinbefore discussed. Secured to the rotary output shaft 52 is a crank 56 having a tubular shank 58 concentric with the shaft 52 and supported in the housing 12 in a bearing 60. Formed in the end of the crank 56 opposite the tubular shank 58 is an eccentric, cylindrical bearing cavity 62 for a bearing 64 which encircles the inner end 34 of the shaft 32.

Figure 8:
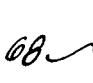
FIG. 8 is a view illustrating the circular orbit described by a point on the outer end of the pulsator head of the invention.
Figure 2:
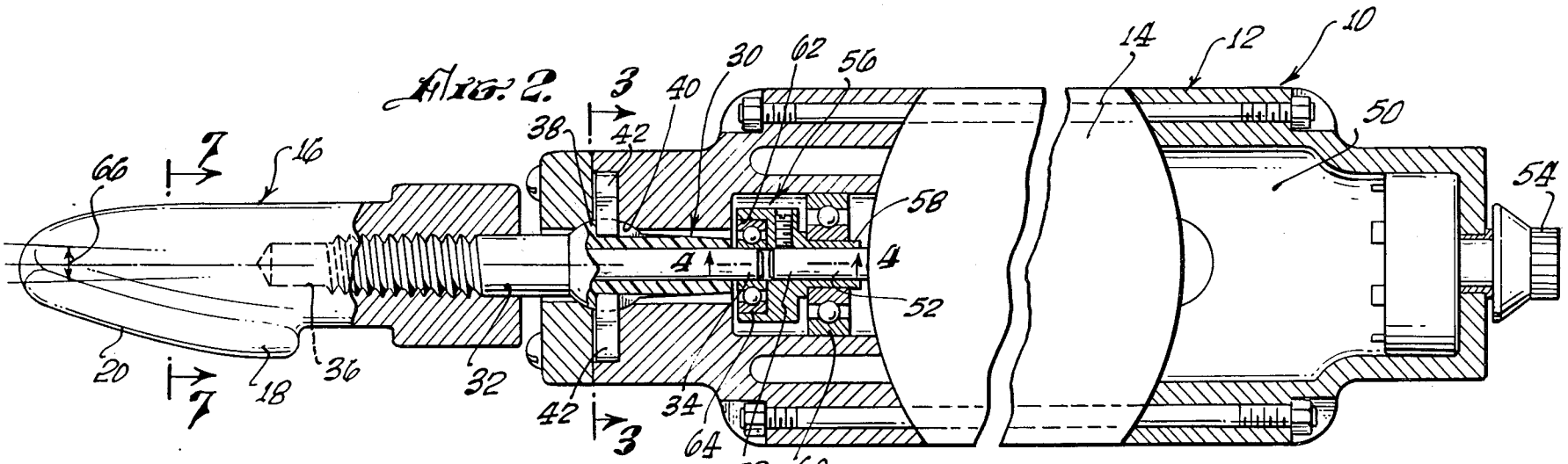
FIG. 2 is a longitudinal sectional view, partially in elevation, of the pulsator of the invention.
Figure 5:
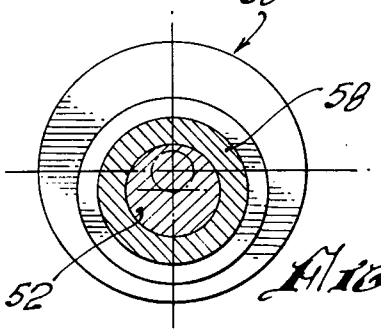
FIG. 5 is a transverse sectional view taken as indicated by the arrowed line 5—5 of FIG. 4.

The eccentricity of the bearing 64 is in such a direction that rotation of the motor shaft 52 causes an inward and outward movement of the surface 20, as indicated by the double-headed arrow 66 in FIG. 2, to apply a pulsating, in-and-out, tapping force to the area 22 to be treated, as hereinbefore discussed. As shown in FIG. 8, a point on the axis of the shaft 32 at the outer end of the head 16 describes a circular orbit 68 because of the eccentric interconnection between the shaft 32 and the motor shaft 52 provided by the drive means 50. The circular orbit 68 has an in-and-out component 66 to produce the pulsating, tapping action hereinbefore discussed.

Figure 4:
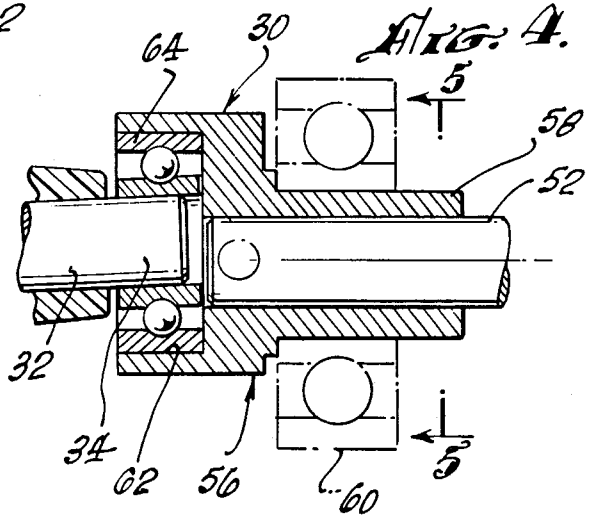
FIG. 4 is an enlarged, fragmentary longitudinal sectional view taken as indicated by the arrowed line 4—4 of FIG. 2, with the eccentricity incorporated in an eccentric rotary drive means of the invention greatly exaggerated.
Figure 3:
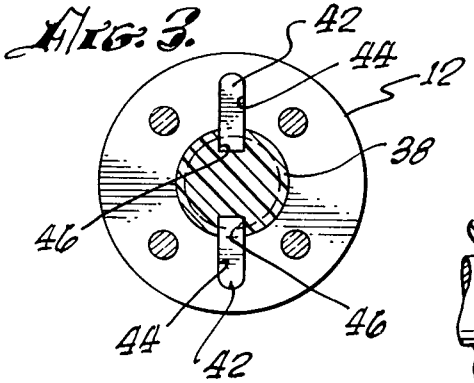
FIG. 3 is a transverse sectional view taken as indicated by the arrowed line 3—3 of FIG. 2.

As previously indicated, the eccentricity of the bearing 64 is shown greatly exaggerated in FIG. 4 of the drawings for clarity. Actually, the axis of the bearing 64 is offset laterally from the axis of the motor shaft 52 a distance, for example, of the order of 0.050 inch.

It is thought that the operation of the pulsator 10 of the invention will be clear from the foregoing description without any further explanation.

Although an exemplary embodiment of the invention has been disclosed fo illustrative purposes, it will be understood that various changes, modifications and substitutions may be incorporated in such embodiment without departing from the invention as hereinafter claimed.

I claim as my invention:

1. A tissue pulsator capable of operating on an area to be treated with a tapping action, said pulsator including a head having on one side thereof a surface engageable with the area to be treated, said head comprising an enlarged, laterally facing pad having said surface on one side thereof, said surface being convex in all directions, and said pulsator including a rotary eccentric drive means connected to said head for laterally moving said surface thereof inwardly and outwardly substantially parallel to itself so as to operate on the area to be treated with a tapping action, said rotary eccentric drive means including:

a. a housing providing a socket;
b. a shaft having inner and outer ends and having intermediate its inner and outer ends a ball disposed in said socket;
c. said head being connected to said outer end of said shaft;
d. a crank connected to said inner end of said shaft;
e. a rotary motor in said housing and substantially coaxial with said shaft and connected to said crank for rotating said crank substantially about the axis of said shaft so as to cause said outer end of said shaft to orbit, thereby laterally moving said surface of said head inwardly and outwardly substantially parallel to itself so as to operate on the area to be treated with a tapping action; and
f. means interconnecting said shaft and said housing for preventing rotation of said shaft about its axis.

2. A pulsator as defined in claim 1 wherein said crank comprises a bearing encircling said inner end of said shaft and eccentrically connected to the shaft of said rotary motor.

3. A pulsator as set forth in claim 2 including means for varying the speed of said rotary motor.

4. A pulsator as set forth in claim 2 including means for varying the speed of said rotary motor between zero and about 5000 revolutions per minute.

* * * * *